United States Patent [19]

Edwards et al.

[11] 3,983,663

[45] Oct. 5, 1976

[54] MODEL RAILWAY REFRIGERATOR CARS

[76] Inventors: Clarence K. Edwards, 1017 Black Oak Drive; Lawrence D. Edwards, 2816 Rosemont, both of Medford, Oreg. 97501

[22] Filed: Aug. 4, 1975

[21] Appl. No.: 601,483

[52] U.S. Cl. ..... 46/218
[51] Int. Cl.[2] ..... A63H 19/16
[58] Field of Search ..... 46/11, 218; 105/377

[56] References Cited

UNITED STATES PATENTS

| | | | |
|---|---|---|---|
| 2,308,468 | 1/1943 | Lundvall | 105/377 |
| 2,658,307 | 11/1953 | Pettit | 46/218 |

*Primary Examiner*—Hugh R. Chamblee
*Assistant Examiner*—Robert F. Cutting

[57] ABSTRACT

In a model railway system it is desirable to include cars which simulate refrigerator cars. Model railway refrigerator cars are not, of course, furnished with ice or other means of actual refrigeration, but they should resemble actual cars which are so furnished, under actual operating conditions. To this end, the roof of each model railway refrigerator car is provided, according to the present invention, with a hatch at each end of the roof, a tiltable cover for each hatch, a retaining means for keeping the cover open, and an alternative retaining means for keeping the cover closed. The present invention has to do with a very simple and economical association of roof and cover and for providing interchangeable latches that hold the cover in open and closed condition, respectively.

5 Claims, 4 Drawing Figures

MODEL RAILWAY REFRIGERATOR CARS

This invention relates to simulated refrigerator cars for model railway systems. The ultimate effect is one of appearance, since no refrigerant is ever put into model railway cars. It is desirable, however, for the simulated refrigerator cars of model railway systems to include realistically every feature of genuine refrigerator cars which is open to view, and every condition in which such feature or features may appear.

In standard railroad practice a refrigerator car has hatches at opposite ends of the roof, and covers which may be operated and set between open and closed positions, and may be set in fully opened or in fully closed positions.

It is a feature of the present invention that hatches and hatch covers are provided for model railway refrigerator cars, which covers may be merely thrust into place and may then be rocked between fully closed and fully open conditions.

It is a further feature that alternatively usable latches are provided, one for retaining a cover in various open conditions, and the other for retaining the cover in a closed condition.

It is a still further feature that the latches are adapted to be thrust into operative position simply by pressure, and withdrawn simply by pulling.

Other objects and advantages will hereinafter appear.

In the drawing forming part of this specification,

Figure 1:
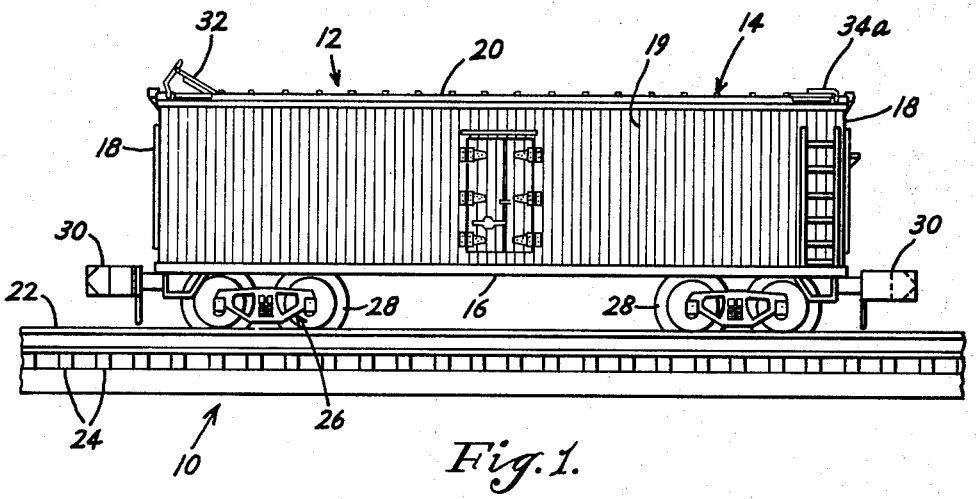
FIG. 1 is a fragmentary view in side elevation of a length of model railway track and a model railway refrigerator car mounted thereon.

In general, the track 10 and the car 12 may be of conventional construction. The car body 14 includes a floor 16, ends 18, sides 19 and a roof 20. The car is supported by tracks 22 which are mounted on cross-ties 24. The car body is carried on trucks 26 which include wheels 28. The car is equipped with couplers 30 of a familiar design at its opposite ends.

Figure 2:
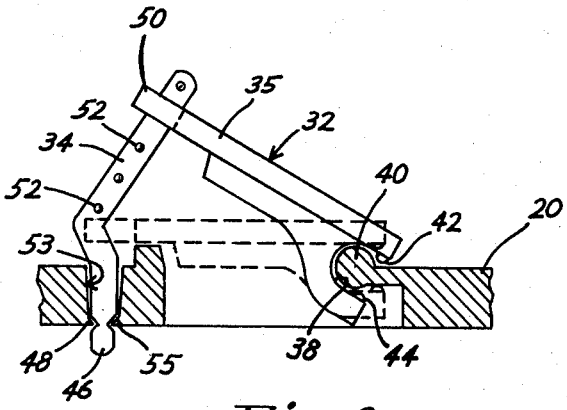
FIG. 2 is a fragmentary, sectional view showing the door or cover at the left end of the car held open by a latch designed for that purpose.

In FIG. 2 a hatch cover 32, applied to the roof 20, is shown retained in an open condition by a latch bar 34. The cover body 35 has unitary with it on its lower side a projection 36. The body 35 and the projection 36 jointly form a generally cylindrical recess 38 for the reception of a cylindrical lip 40 which is unitary with the roof 20.

The roof 20 is of relatively rigid construction but the cover body 35 and the projection 36 are of relatively yieldable, resilient material. These members terminate in tits 42 and 44 which are spaced from one another by a distance substantially less than the diameter of the lip 40. The cover may be suitably applied to the lip 40 simply by thrusting the cover into place. The tits 42 and 44 spread to accommodate the lip and then recover to retain the lip in the circular recess 38.

The tits 42 and 44 are, however, located far enough apart to permit the cover to be swung from the position in which it is shown in full lines in FIG. 2 to the position in which it is shown in dotted lines in that figure.

The latch bar 34, like the cover 32, can simply be pressed into place, the latch bar 34 being formed with a head 46 and a neck 48, while the relatively rigid car roof 20 is formed with tits 55 between which the head 46 may be thrust. The cover 32 is formed with a neck 50 for cooperation with the latch bar 34. The latch bar 34 is formed with projections 52 for retaining the cover in different open positions.

The latch bar is non-circular in cross-section, preferably rectangular to prevent disorientation, and the opening 53 in the roof for receiving the latch bar is of corresponding cross-section.

Figure 3:
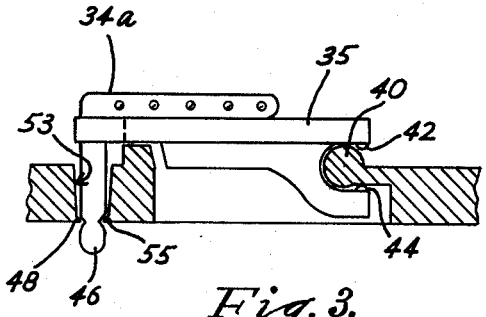
FIG. 3 is a view similar to FIG. 2 but showing the same door or cover held closed by another latch designed for that purpose.
Figure 4:
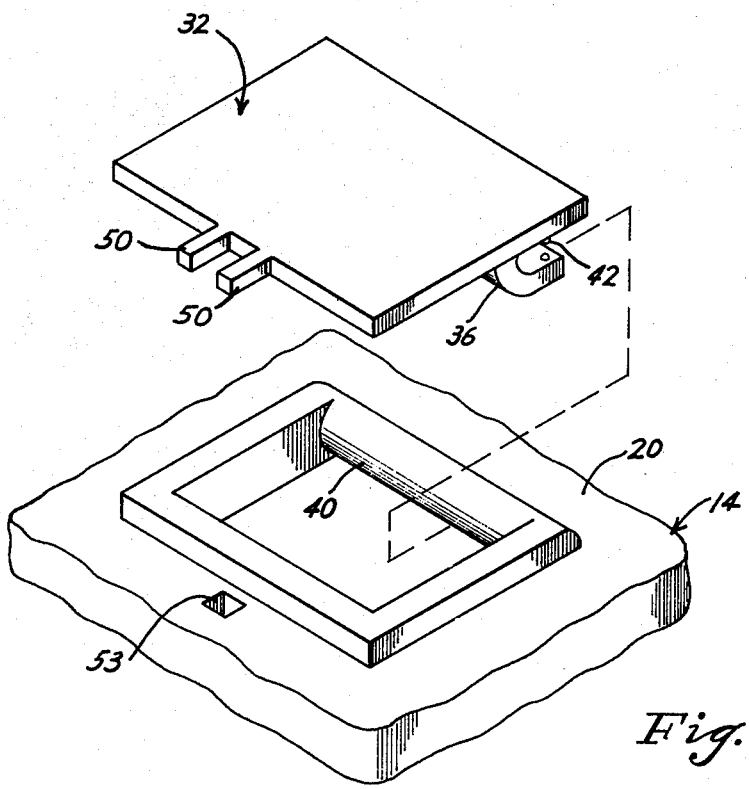
FIG. 4 is a fragmentary, exploded perspective view showing complementary portions of the unattached car roof and cover.

It is not feasible to get the latch bar 34 down flat on top of the cover when the cover is completely closed. Because the latch bar is composed of yieldable material, however, it can not only be pressed into place but it can be withdrawn at will and replaced by a similar bar 34a. The bar 34a has a sharp, essentially a right angle turn, as will be apparent from an inspection of FIG. 3. When the cover 35 is closed the latch bar 34a lies flat on top of it and holds it down.

We have described what we believe to be the best embodiment of our invention. What we desire to secure by letters patent, however, is set forth in the appended claims.

We claim:

1. A model railway simulated refrigerator car having a roof member, a hatch at the end of the roof member, and a cover for the hatch, said roof member including a parti-cylindrical lip for pivotally supporting the cover, and said cover having a parti-cylindrical recess which is bounded at its extremities by tits which are normally separated from one another by a distance which is less than the diameter of the parti-cylindrical lip, the cover being composed of resiliently yieldable material so that the tits can be caused to be temporarily spread and then to recover during application of the cover to the lip, thereby enabling the cover to be affixed to the lip by a simple thrusting motion.

2. A model railway simulated refrigerator car as set forth in claim 1 in which the tits on the cover are normally located substantially farther apart than the thickness of the roof portion to which the parti-circular lip is connected so that the applied cover can be swung through a substantial angle without significant deformation of the cover.

3. A model railway simulated refrigerator car as set forth in claim 2 which further includes a latch of resilient material cooperative with the cover for frictionally engaging the cover to detain the cover in any one of a variety of open conditions, said latch including a body portion, a head at its lower end and a neck of reduced cross-section through which the body portion is connected to the head, the roof having an opening for containing a substantial length of the body portion of the latch and having inwardly extending flange means at its lower end, the construction and arrangement being such that the latch may be put in place by a simple thrusting action and may then be yieldingly retained in place by lodgment of the neck recesses of the latch in positions to be occupied by the flange means of the roof.

4. A model railway simulated refrigerator car as set forth in claim 3 in which the latch means includes a slanted portion engageable by the cover in various slanted positions of the cover.

5. A model railway simulated refrigerator car as set forth in claim 3 in which the latch means includes a horizontal portion when installed that overlies the cover and retains the cover in a closed condition.

* * * * *